US006942061B2

(12) United States Patent
Butterfield et al.

(10) Patent No.: US 6,942,061 B2
(45) Date of Patent: Sep. 13, 2005

(54) MUFFLER FOR INTERNAL COMBUSTION ENGINE

(75) Inventors: David A. Butterfield, Mountain Home, AK (US); Jerry E. Myers, Mountain Home, AK (US)

(73) Assignee: Jones Exhaust Systems, Inc., Adamsville, TN (US)

( * ) Notice: Subject to any disclaimer, the term of this patent is extended or adjusted under 35 U.S.C. 154(b) by 0 days.

(21) Appl. No.: 10/738,747

(22) Filed: Dec. 17, 2003

(65) Prior Publication Data

US 2005/0133301 A1 Jun. 23, 2005

(51) Int. Cl.[7] ..... F01N 1/08; F01N 1/06
(52) U.S. Cl. ..... 181/275; 181/268; 181/281
(58) Field of Search ..... 181/268–270, 181/275, 264, 281, 282, 227, 228, 238, 251, 181/257; 180/309, 296, 89.2, 68.3

(56) References Cited

U.S. PATENT DOCUMENTS

| | | | | | |
|---|---|---|---|---|---|
| 937,665 | A | * | 10/1909 | Walton | 181/268 |
| 2,290,818 | A | * | 7/1942 | Tyskewicz | 181/265 |
| 2,339,834 | A | * | 1/1944 | Bourne | 181/231 |
| 3,196,978 | A | * | 7/1965 | Leistritz | 181/268 |
| 4,164,267 | A | | 8/1979 | Meineke et al. | |
| 4,279,326 | A | | 7/1981 | Meineke et al. | |
| 4,475,623 | A | * | 10/1984 | Gerber et al. | 181/243 |
| 4,601,363 | A | * | 7/1986 | Harris et al. | 181/280 |
| 4,809,812 | A | * | 3/1989 | Flugger | 181/268 |
| 5,123,502 | A | * | 6/1992 | Flugger | 181/264 |
| 5,444,197 | A | * | 8/1995 | Flugger | 181/264 |
| 5,669,762 | A | * | 9/1997 | Lee | 417/312 |
| 5,739,484 | A | * | 4/1998 | Jones | 181/264 |
| 5,936,210 | A | * | 8/1999 | Borneby et al. | 181/264 |
| 5,952,625 | A | | 9/1999 | Huff | |
| 6,089,347 | A | * | 7/2000 | Flugger | 181/264 |
| 6,286,623 | B1 | * | 9/2001 | Shaya | 181/264 |
| 6,382,347 | B1 | * | 5/2002 | Gerber | 181/227 |
| 6,571,910 | B2 | | 6/2003 | Storm | |
| 6,595,319 | B1 | | 7/2003 | Huff | |
| 6,622,821 | B2 | * | 9/2003 | Butler | 181/270 |
| D492,634 | S | * | 7/2004 | Butterfield et al. | D12/194 |

FOREIGN PATENT DOCUMENTS

| | | | | |
|---|---|---|---|---|
| JP | 03246312 A | * | 11/1991 | F01N 1/02 |

* cited by examiner

*Primary Examiner*—Edgardo San Martin
(74) *Attorney, Agent, or Firm*—Pitts & Brittian, P.C.

(57) ABSTRACT

A performance muffler suitable for installation into an exhaust system for an internal combustion engine wherein either end of the muffler may be designated as the entrance end for the receipt of exhaust gases into the muffler without materially altering the functionality of the muffler. A method is disclosed.

17 Claims, 5 Drawing Sheets

MUFFLER FOR INTERNAL COMBUSTION ENGINE

RELATED APPLICATIONS

Not Applicable

STATEMENT REGARDING FEDERALLY SPONSORED RESEARCH OR DEVELOPMENT

Not Applicable

FIELD OF INVENTION

This invention relates to mufflers for internal combustion engines, and particularly to automotive vehicle mufflers.

In general, the muffler for an internal combustion engine functions to suppress or modulate the sound (noise) emanating from the firing of fuel within the cylinders of the engine. A major limitation on the means employed to suppress such noise is the need to minimize back pressure toward the engine and the accompanying reduction in the efficiency of operation of the engine due to such back pressure.

Heretofore, suppression of the engine exhaust noise(s) has been approached by use of mufflers connected in fluid flow communication with a manifold with which the exhaust ports from the engine cylinders are connected. Exhaust gases and sounds associated with the firing of a fuel in the individual ones of the cylinders are received by the muffler. Within the muffler of the prior art, various devices and/or techniques have been employed to suppress the noise aspect of the gas flow through the muffler and exiting therefrom. Sharp turns, sharp edges, packing of various types, baffles, and tubing (perforated and non-perforated) are among the devices and techniques heretofore employed to alter the flow of the gases and accompanying noise through the muffler in attempts to change the direction of flow of the gases and accompanying noise as they pass through the muffler, all with the intent to reduce the noise level exiting the muffler while minimizing the resistance to flow of the gases through the muffler, thereby minimizing the back pressure to the engine. Because of the means employed within the muffler to alter the direction and/or velocity of flow of the gases internally of the muffler, these prior art mufflers commonly are operative only for the flow of gas from the entrance end of the muffler and out the exit end of the muffler. These prior art mufflers are unidirectional in that they will function only when the gases enter an aforehand designated entrance end of the muffler. Connection of the non-entrance, i.e., exit, end of the muffler to the exhaust manifold (or exhaust pipe) of the engine can generate sufficient back pressure as to damage the engine. Because of the large number of differing designs (makes, models, etc.) of motor vehicles, for example, and the engines available for each design, it is common that each motor vehicle design requires a muffler designed to "fit" each motor vehicle design. This "fit" may dictate a physical size requirement or a geometrical requirement (such as a cross-sectional geometry), etc.

The functional unidirectionality of the prior art mufflers results in a requirement that those entities in the chain of manufacture, distribution, retail sale and installation, etc. of replacement or retrofit mufflers must, at each level, not only maintain an inventory of mufflers which includes at least the most commonly used muffler designs, but each muffler must possess an entrance end and an exit end which are each compatible with the location of the exhaust pipe leading from the manifold and the tail pipe which is connected to the exit end of the muffler to convey the gases exiting the muffler away from the motor vehicle. Such inventories are very costly and contribute significantly to the expense associated with mufflers, particularly to mufflers provided in the after market for internal combustion engine components.

BRIEF SUMMARY OF THE INVENTION

In accordance a muffler for an internal combustion engine wherein the muffler is functionally bidirectional with respect to the direction of flow of exhaust gases and associated sounds through the muffler. This bidirectionality of gas flow through the inner volume of the muffler provides suppression of sound and minimization of the resistance of gas flow through the muffler, hence minimization of back pressure to the engine, irrespective of the direction of gas flow through the muffler. Consequently, only the physical location of the entrance and exit ports associated with the opposite ends of the muffler need be chosen to "fit" a given motor vehicle, for example. In accordance with one aspect of the present invention, the inventor provides multiple ports on one or both ends of a given muffler, thereby permitting the end user to choose one or more of the entrance ports for connection to the existing manifold exhaust pipe and/or to choose one or more of the exit ports for connection to the existing tail pipe of the vehicle. Any such ports, either entrance or exit, which are unneeded are readily closed, for example by means of a cap or preferably a plug applied to and sealing the unneeded port or ports closed.

In accordance with a further aspect of the present invention, the functional elements disposed internally of the housing of the muffler offer smooth, uniform minimal resistance to the flow of gases therepast, while imparting substantial turbulence, irrespective of the direction of flow of the gases relative to the functional elements. Further, reduction of at least certain relatively high frequency noises entering the muffler via the exhaust gases are muted by at least one, and preferably plural, hollow tubes which extend across the width of the muffler housing and whose opposite ends are partially open and thereby exposed to gases filling the muffler and/or flowing through the muffler. This feature has been found to produce a chamber within each tube wherein high frequency sounds associated with the gases flowing through the muffler are suppressed or cancelled.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

In the present description, like elements in different embodiments are at times identified by primed numerals.

Figure 1:
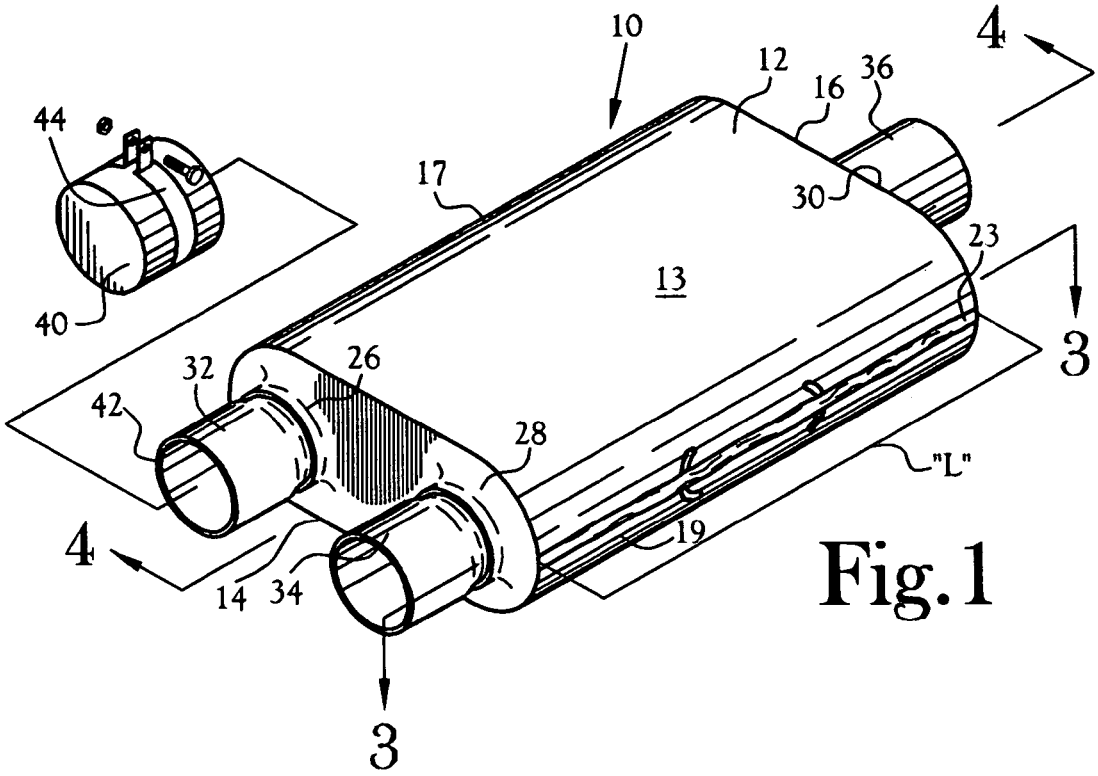
FIG. 1 is a schematic representation of a muffler embodying various of the features of the present invention.
Figure 2:
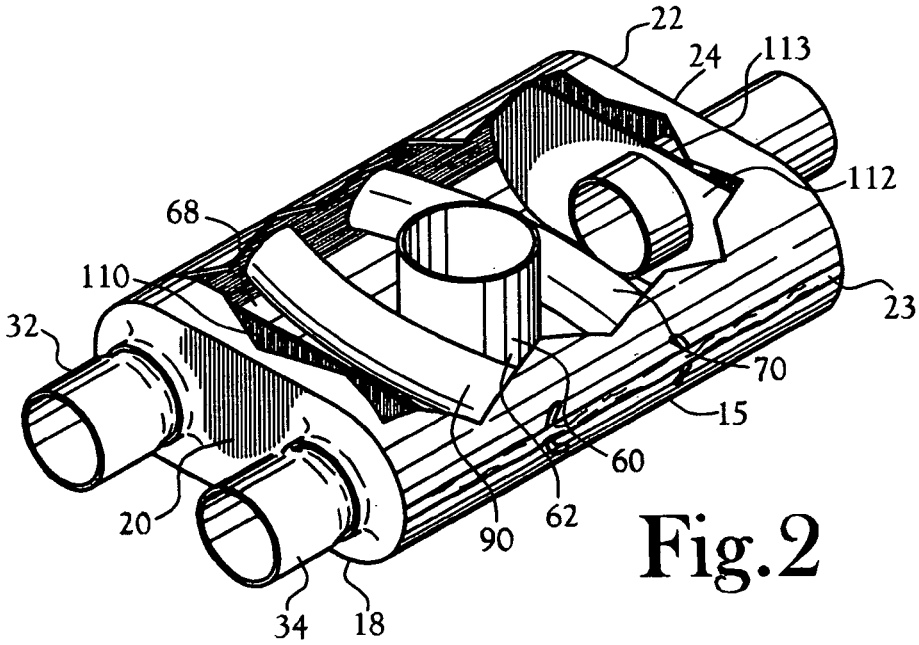
FIG. 2 is a partially cut-away view of the muffler depicted in FIG. 1.

Referring initially to FIGS. 1 and 2, one embodiment of a muffler 10 of the present invention includes an elongated hollow housing 12 having a first end 14 and a second end 16. The depicted muffler is of uniform oval cross-section along the length "L" thereof. The housing 12 is defined by a top wall 13, a bottom wall 15 (see FIG. 4) and first and second side walls 17 and 19, respectively, This housing may be formed from any of several acceptable materials, one suitable material being 16 gauge AKDQ T125 aluminized steel. In one example, the cross-section taken along the transverse centerplane 21 (see FIG. 4) of the housing may have a major dimension of about 9.75 inches and a minor dimension of about 4 inches. The length of this example is about 12 inches. It will be readily recognized by one skilled in the art that other dimensions and cross-sectional geometries for the housing may be chosen for a given muffler for a given motor vehicle, for example.

The hollow housing 12 is closed at a first end 18 by a first end plate 20. The second end 22 of the housing is closed by a second end plate 24. These plates preferably are of like material as the housing and preferably are welded in place to provide a leak-tight closure of a respective end of the housing.

Figure 3:
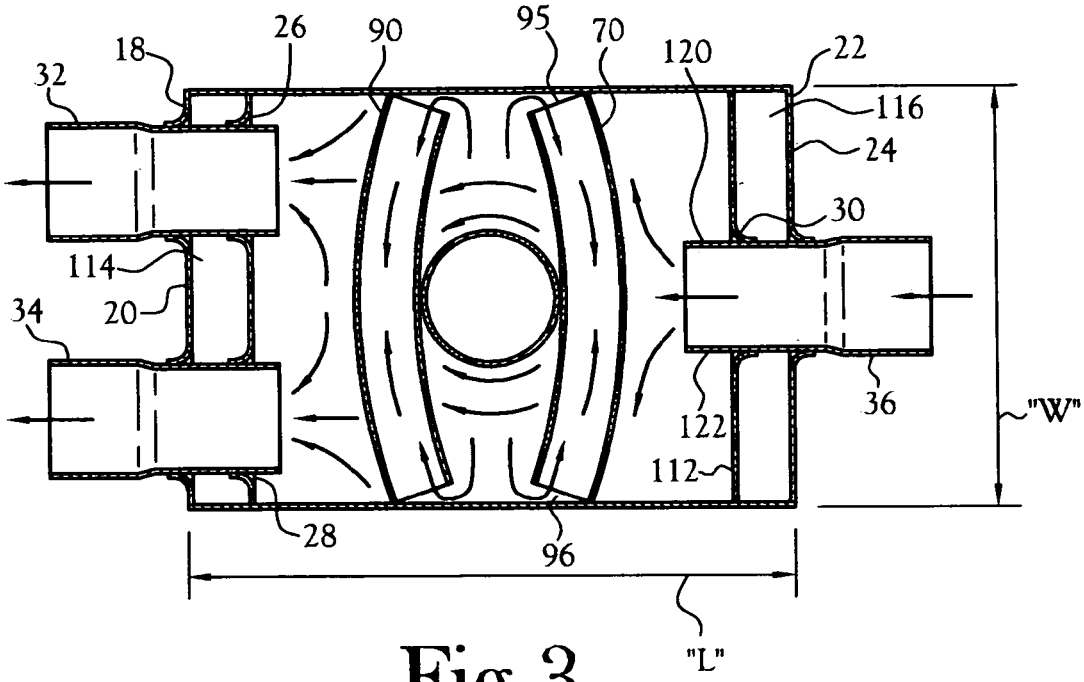
FIG. 3 is a cross-sectional view taken generally along line 3—3, of the muffler depicted in FIG. 1 and depicted one flow path of gases passing through the muffler.

In the embodiment depicted in FIGS. 1, 2 and 3, in the first end plate 20 of the muffler there are provided first and second ports 26 and 28 through the thickness of the end plate 20. Further, in the second end plate 24 there is provided a single port 30. In the depicted embodiment, each port is provided with a stub pipe 32, 34, and 36, respectively, for use in connecting the ends of the muffler in fluid communication with a manifold exhaust pipe(s) (not shown) and a tail pipe(s)(not shown) as is well known in the art. Notably, in the present invention, either of the first or second ends may be connected to the exhaust manifold pipe(s) or to the tail pipe(s). To this end, as is conventional in the art, the outwardly disposed end of each stub pipe is provided with an internal diameter which is slightly greater than the outer diameter of the exhaust pipe or tail pipe that is to be received therein. The stub pipe is tapered to an internal diameter which is equal to or smaller than the outside diameter of the associated exhaust pipe or tail pipe.

In accordance with one aspect of the present invention, internally of the hollow housing of the muffler, there is provided a circular post 60 which preferably is disposed substantially equidistant from the opposite ends 20, 22 of the housing and extending between the top and bottom sides of the housing. At least one end 62, and preferably both ends, of this post is anchored, as by welding, to at least one of the top and bottom walls of the housing, and preferably to both walls, thereby providing rigidity and crush strength to the housing. One suitable post in the muffler example referred to above is a section of a 3 inch diameter steel pipe. In the preferred embodiment, this post is located coincident with the intersection 64 of the longitudinal centerplane 66 and the transverse centerplane 21 of the housing, thereby positioning the post substantially in the exact center of the interior 68 of the housing.

Figure 7:
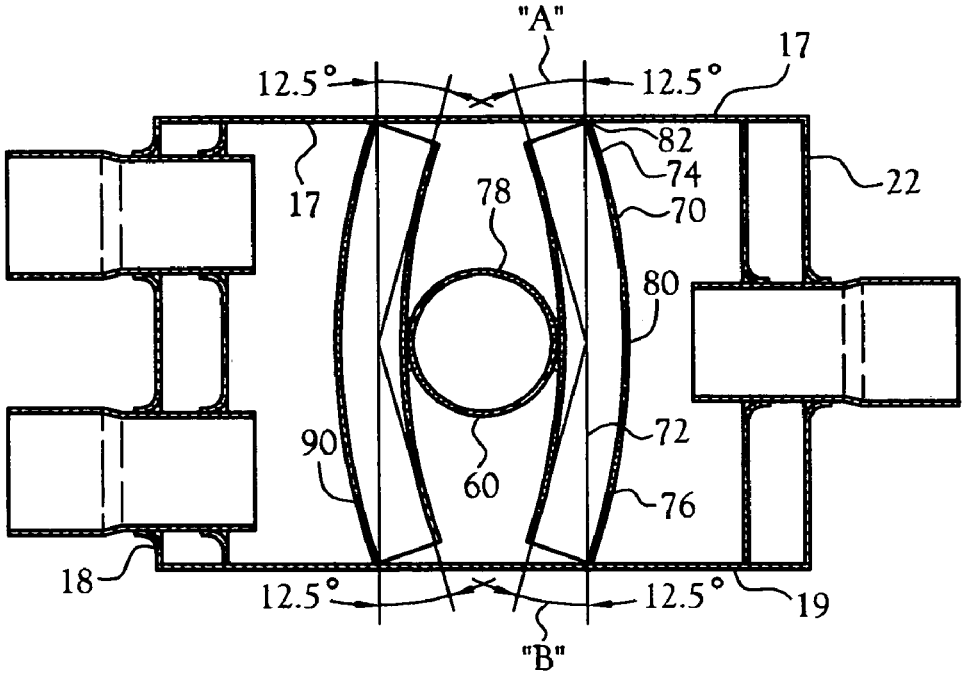
FIG. 7 is a cross-sectional view as in FIG. 3 and depicting the angularity of first and second tubes which extend across the width of the muffler internally thereof.
Figure 8:
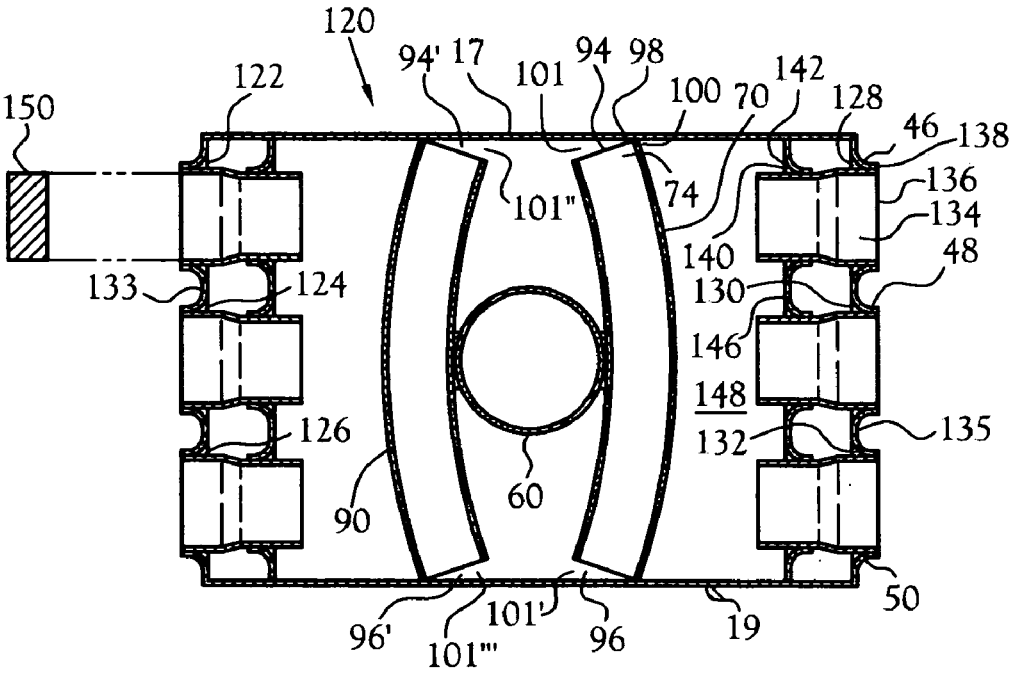
FIG. 8 is a cross-sectional view as in FIG. 3 and depicting a further embodiment of a muffler having multiple entrance and exit ports.

In the embodiment depicted in FIGS. 2,3,4 and 8, on one side of the post there is provided a first hollow bent tube 70 (1.5 inch diameter in the example given above) which extends fully across the width of the housing. This tube is bent along its length at an included angle of about 25 degrees with respect to the longitudinal centerline 72 of the tube, there being a bend (angles "A" and "B") of about 12.5 degrees on opposite ends 74,76 of the tube as best seen in FIG. 8. The plane which contains the bend is disposed substantially parallel with the longitudinal centerplane of the housing (perpendicular to the transverse centerplane of the housing) in the embodiment depicted in FIGS. 1 and 7 and the angle of bend tends to cause the tube to partially encircle the outer circumference 78 of the post thereby positioning the opposite ends 74,76 of the tube substantially equidistantly from the second end of the housing, but further from the second end 22 than the central portion 80 of the tube where the bend originates. Referring specifically to FIGS. 7 and 8, notably, when the tube ends have been cut perpendicular to the length of the tube, ie., square ends of the tube, at the time the tube is bent and positioned between the side walls 17,19 of the housing, only a short arcuate portion of each end of the tube will physically engage, and preferably welded 100, a respective side wall of the housing. This arcuate portion of each end of the tube is anchored to its respective side wall, as by welding, to securely anchor each of the ends, hence the tube itself, in place across the width of the housing. As desired, the central portion 80 of the tube may also be anchored to the post 60, e.g, by welding. These anchor points not only serve to position the tube within the housing, but collectively serve to rigidify and provide crush strength to the housing.

Also in the embodiment depicted in FIGS. 2,3,4 and 7, there is provided a second hollow bent tube 90 which is substantially identical to the first tube 70 except that the bend in the second tube is oriented in the opposite direction to the bend in the first tube. This second tube is disposed within the same plane as the first tube, but on that side of the post opposite the first tube as seen in FIG. 7. The ends of the second tube, and preferably its central portion, are anchored (e.g. welded) to the opposite side walls of the housing and to the central post in like fashion as the first bent tube.

Referring specifically to FIGS. 3,7, and 8, it will be seen that in the present invention, the positioning of the bent tube 70 between the side walls of the housing provides openings 94,96 between the ends 74,76 of the tube 70 and a respective side wall 17,19 of the housing. This opening 94 is substantially of a wedge geometry having its narrow edge 98 adjacent the location of the weld joint 100 between the end of the tube and the respective side wall 17 of the housing. Thus, the opening widens from its most narrow edge outwardly from the weld location to its widest portion 101. In the example given herein above, the maximum width of this wedge-shaped opening is about 5/16 inch when employing a 1.5 inch diameter bent tube and depicted angles "A" and "B". It is to be noted that the orientation of the tubes within the housing positions the widest portion 101 of the wedge-shaped opening in the path of flow of gases from one end of the housing and the widest portion 101' of the other and opposite tube 90 in the path of flow of gases from the opposite end of the housing.

Figure 4:
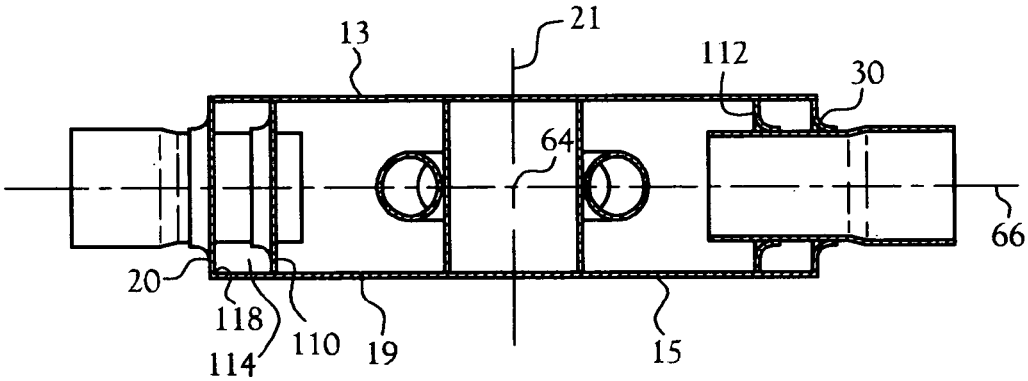
FIG. 4 is a cross-sectional view taken generally along line 4—4 of the muffler depicted in FIG. 1.
Figure 5:
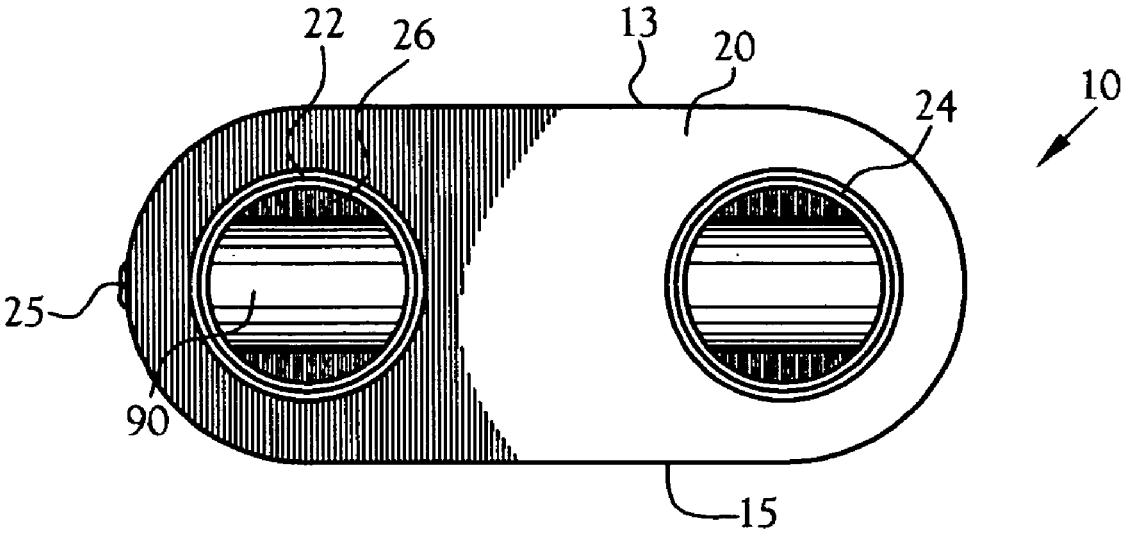
FIG. 5 is an end view of a first end of the muffler depicted in FIG. 1.
Figure 6:
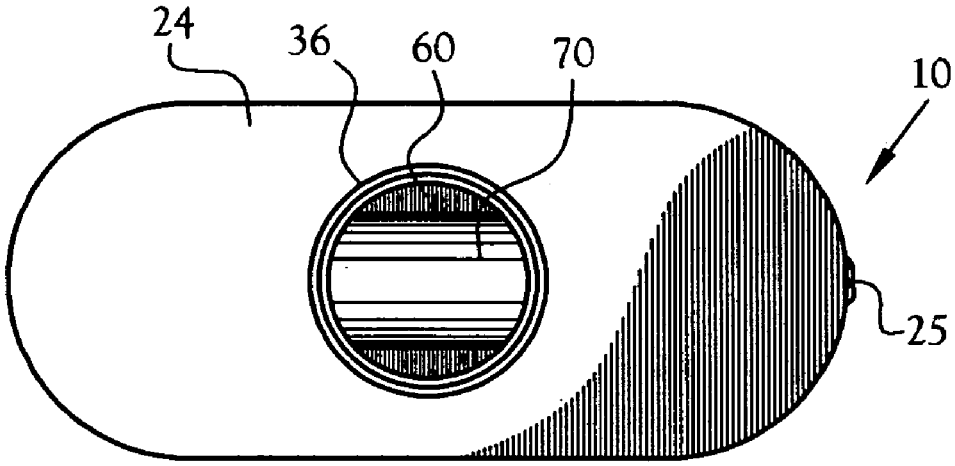
FIG. 6 is an end view of a second and opposite end of the muffler depicted in FIG. 1.

In the embodiment depicted in FIGS. 3,4, and 7, the opposite ends of the second bent tube 90 likewise define wedge-shaped openings 94, 96 between the opposite ends of the second tube and the side walls 17 and 19. It is to be noted that the orientation of the tubes within the housing positions the widest portions 101, 101' of the wedge-shaped openings 94, 96 in the path of flowing gases from one end 18 of the housing. Specifically the widest portions 101, 101' of the openings at the ends of the first bent tube face the first end 18 of the housing while the widest portions 101", 101'" of the openings between the opposite ends of the second bent tube 90 and the side walls 17 and 19 face the second end 22 of the housing. By this means, irrespective of which end of the muffler is chosen as the entrance end for exhaust gases, within the muffler, the gases are subjected to the same flow interruptions and or directional deviations as they pass through the muffler.

It will be further noted, that when the gases fill the muffler and develop pressurized gases within the muffler, such gases will flow into either or both of the bent tubes 70 and 90. Also it will be still further noted that gases enter both ends of each of the tubes. Whereas the exact reason for such is not known, it has been found that this configuration of the openings and their positions within the housing relative to the gas flow into and through the housing results in modulation of noise, especially relatively high frequency noise, associated with the gases flowing into and through the housing, even to the point of cancellation of such noises.

To install the present muffler as a part of the exhaust system for an internal combustion engine, at least one of the ports in one end of the muffler is connected in fluid communication with the exhaust pipe leading from the engine exhaust manifold, for example. This port then becomes the inlet port for the muffler. Further, at least one other of the ports is connected in fluid communication with a tail pipe or similar device for directing the outflow from the muffler away from the vehicle, all as is well known in the art.

The flow of gases and associated noise through the housing of the present muffler is schematically depicted by the arrows in FIG. 3. As depicted, in the embodiment shown in FIG. 3, there is a single inlet port in one end of the muffler and two outlet ports at the exit end of the muffler. Gases and associated noises entering the inlet end 22 of the muffler initially build up pressure within the muffler thereby eventually forcing such gases out through the exit ports 26, 28. (FIG. 1). As the gases enter the housing, they flow laterally of the housing and forwardly past the first bent tube 70, past the post, 60, thence past the second bent tube 90, thence out of the muffler through the two exit ports 26, 28. Within the interior of the muffler, a portion of the gases is forced into the interior of the second tube 90 through the wedge-shaped openings associated with the opposite ends of this tube, the gases simultaneously entering the openings at the opposite ends of the tube. Sound associated with the gases flowing into this tube have been found to cancel one another, especially relatively higher frequency sounds, thereby deleting at least a substantial portion of these higher frequency sounds from those sounds which eventually exit the muffler. The effect of this action is to render those sounds which exit the muffler more bass in nature as is desired in many mufflers. Because the gases within the muffler are under pressure, some of the gases enter the wedge-shaped openings 101, 101' associated with the first bent tube 70. Again the higher frequency noises associated with these gases are at least partially cancelled out within the first tube, thereby adding to the more desirable sound output from the muffler. Should the flow through the muffler be opposite in direction to the flow depicted in FIG. 3, the resultant modulation of the exhaust bases is the same.

Importantly, in the present invention, there are no sharp bends, no sharp edges such as produced with baffles, no perforations with their sharp edges, all of which tend to contribute to the generation of back pressure to the engine. In the present invention, the gases are guided past smooth rounded surfaces to reduce the velocity of the gas flow through the muffler and to provide a gas expansion volume which contributes to the reduction of noise associated with the exhaust gases. Of particular importance in the present invention is the observed increase in horsepower of a given internal combustion engine whose exhaust gases are muffled employing a muffler of the present invention.

In accordance with a further aspect of the present invention, there is provided internally of the housing first and second end baffles 110, 112, respectively. The first baffle 110 is disposed adjacent, but spaced apart from, the first end plate 20 of the housing. The second baffle 112 is disposed adjacent, but spaced apart from the second end plate 24 of the housing. Each baffle is formed from aluminized steel or like metal, and is oriented substantially parallel to its respective end plate and extends fully across the cross-section of the housing. The perimeter 113 of each baffle 112, for example, is force-fitted into the housing to develop a substantially leak-tight engagement of the full perimeter of the baffle with the interior surfaces of the walls of the housing. Each baffle preferably is also anchored to one or more of the inner walls of the housing as by welding. This baffle feature of the present invention further provides support for the inward end of a stub pipe (or tubing bracket) and rigidifies the stub pipe (and an exhaust or tail pipe mounted therein) thereby enhancing the resistance of the present invention against failure due to vibration of the pipes and the muffler.

In one embodiment, each baffle 110,112 is spaced apart from its respective end plate by a distance sufficient to define a substantially closed chamber 114 and 116, respectively, between the baffle and its respective end plate. In the example referenced hereinabove, the spacing between a baffle and its end plate may be about one inch. As is recognized in the art, there is a tendency for moisture from the exhaust gases entering a muffler to condense and accumulate at the junction 118 of the bottom wall 15 of the housing and that end plate (20 in FIG. 4) which is opposite the entrance port (depicted at port 30 in FIG. 4) for the gases entering the muffler. This accumulation of water promotes rust and premature failure of the muffler in this location. In the present muffler, that baffle (110, for example) which is adjacent that end plate which is opposite the entrance port for the exhaust gases serves as a barrier against the passage of moisture past the baffle into the chamber 114, hence substantially eliminates the accumulation of moisture at the junction of the bottom wall of the housing and that end plate associated with the baffle. Notably, there is a like baffle at each end of the housing so that protection against moisture accumulation in the vicinity of an end plate of the muffler is minimized irrespective of which end of the muffler is chosen as the entrance or exit end for the exhaust gases.

Most commonly, performance mufflers are an after market product. As a result, manufacturers, distributors, installers, and/or retail outlets must maintain an inventory of mufflers for a relatively large number of motor vehicles and/or engine types. In accordance with one aspect of the present invention, the required inventories of mufflers is dramatically reduced by the provision of a muffler which includes a plurality of ports in at least one end, and preferably both ends of the muffler. More specifically, most commonly, a muffler will be required to be amenable to attachment to an exhaust pipe at one end of the muffler and to a tail pipe or the like. Exhaust pipes most commonly are between 1.75 inches and 3 inches in outside diameter. Tail pipes commonly, but not necessarily, are of the same outer diameter as the outer diameter of the exhaust pipe of the vehicle.

Ports or stub pipes for the muffler of the present invention may vary between about 1.75 and about 5 inches in inside diameter at their outward ends. Any unused ports may merely be disabled by closing them as by a cap 40 (FIG. 1) fitted over the outboard end 42 (typical) of a stub pip 32 for example, and secured as by a clamp 44 of conventional design. Preferably, any unused ports are sealed to a respective port (See FIG. 8) as by a solid metal plug which is welded in closing relationship to a respective port.

In accordance with one aspect of the present invention, there is provided a muffler preferably having a plurality of ports in at least one end, and preferably in both ends of the muffler along with associated stub pipes inserted in each port. With specific reference to FIG. 8, in a still further embodiment of the present invention there is provided a muffler 120 as depicted in FIGS. 1–7 with the distinction that the muffler of FIG. 8 includes three ports 122, 124, 126 and 128, 130, 132, respectively, in each of the opposite end plates 133, 135 thereof. Further, the muffler depicted in FIG. 8 does not include stub pipes which project outwardly of a respective end plate of the housing. Rather, the ports.

Of the muffler depicted in FIG. 8 are each fitted with a tubular adaptor 134 (typical) whose outward end 136 terminates substantially flush with the rim 138 of a respective port 128 for example, and whose inward end 140 passes through the registered port 142 in the adjacent baffle 146 and beyond the baffle a short distance (e.g., about one inch in the example given hereinabove) into the interior 148 of the housing. In this muffler, the tubular adaptors, preferably are all of the same inner diameter. Thus, a distributor, dealer or the like, need only stock mufflers of the most common sized exhaust/tail pipes, e.g., 2.0; 2.25; and 2.50 inches outer diameter.

The muffler of FIG. 8 may be offered to the end user as a "kit" which includes four plugs 150 that are adapted to be welded in closing relationship to any unused ports in either end of the muffler. Thus the end user is provided with a single muffler which can be adapted to fit any of a large number of combinations of exhaust pipes and tail pipes, for example, one exhaust gas inlet port and one exit port, one exhaust gas inlet port and up to four exit ports, or other combinations of inlet ports and exit ports.

As depicted in FIG. 8, the internal functional elements of the muffler are substantially identical in structure and function to the like internal functional elements of the muffler embodiment depicted in FIGS. 1–7. Thus, such common internal functional elements bear the same numerals in FIG. 8 as in FIGS. 1–7.

All of the ports in the end plates of this embodiment of the muffler are of like diameter. For example, recalling that one or more of the ports may be chosen as an inlet or an exit port for gases entering and leaving the muffler, the muffler of the present invention provides the end user with multiple options for fitting of the muffler to an existing exhaust system of a motor vehicle. For example, the end user may utilize only one inlet port and only one outlet port, or one inlet port and two outlet ports, or two inlet ports and one outlet port, or other combinations of inlet and outlet ports. Further, the choice is available to select the inlet and outlet ports to be on the same end of the muffler. As noted, any unused ports may be closed, as by a plug, or the like, without adversely affecting the desired functioning of the muffler. The distributor or dealer thus may keep a much smaller inventory of mufflers than heretofore required to timely service customer orders.

It will be recognized that a distributor, for example, may maintain an inventory of only three types of mufflers (mufflers having 2 inch, 2.25 inch and 2.50 inch inner diameter stub pipes) to have available a muffler in inventory which can be promptly installed on the most common motor vehicle exhaust systems. Each of these mufflers includes the same combination of internal components and arrangement of components internally of the housing. That is, only the number of openings in each end plate and the number of associated stub tubes differs from muffler to muffler. This inventory reduction feature extends backward through distributors and manufacturers, thereby reducing the eventual cost of the muffler to the end user. As desired, the mufflers of the present invention may be sold as a kit which includes one or more caps or plugs for closing off unused stub pipes of the muffler. Attachment of caps or plugs preferably is by welding.

Figure 9:
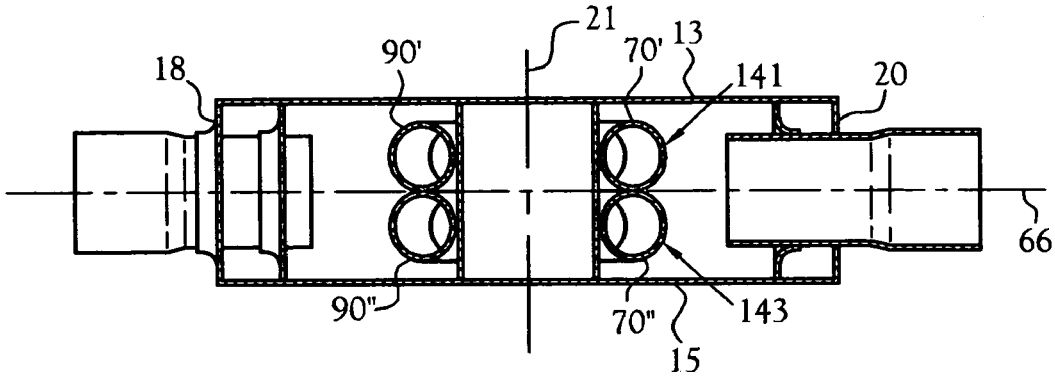
FIG. 9 is cross-sectional view as in FIG. 4 and depicting a further embodiment of the present invention which includes stacked layers of hollow bent tubes; and, FIG. 10 is a partially cutaway view of an alternative embodiment of the muffler depicted in FIG. 2.

In a further embodiment of the present invention, there is provided internally of the housing of the muffler a plurality of stacks of bent tubes. Specifically, and referring to FIG. 9, in the depicted embodiment there are proved a first stack 141 of bent tubes 90' and 70' and a second stack 143 of bent tubes 90" and 70". All other features of this embodiment of the muffler may be substantially identical to the features of the muffler depicted in FIGS. 1–8 as discussed hereinabove.

Figure 10:
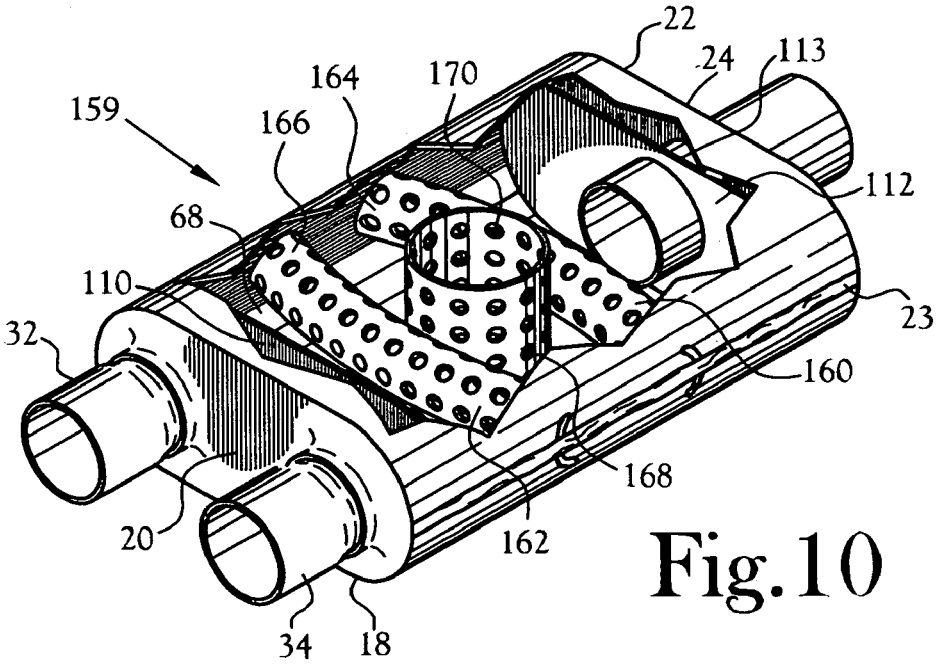

Referring to FIG. 10, in an alternative embodiment, a muffler 159 such as depicted in FIG. 2, is provided with like internal elements as the muffler depicted in FIG. 2, except in the alternative embodiment, each of the bent tubes 160 and 162 is provided with a respective pattern of perforations 164 and 166, respectively, and, as desired, the central tubular post 168 may be provided with a plurality of perforations 170 through the wall of each member. In this embodiment, the perforation pattern of the bent tube 160 is a mirror image of the perforation pattern of the bent tube 162. In like manner, the pattern of perforations associated with the post 168 provides for perforations on that half of the post facing toward the exit end of the muffler to be a mirror image of the perforations on that half of the post facing the entrance end of the muffler. Accordingly, exhaust gases entering either end of the muffler experience the same flow impediments as they pass through the length of the muffler. Whereas such alternative embodiment offers reduced noise levels associated with the gases exiting the muffler, the perforations tend to increase the back pressure to the engine of the vehicle.

Whereas the present invention has been described employing specific sizes and examples, it will be recognized by one skilled in the art that other sizes and modifications are permissible so that the scope of the invention is to be limited only as set forth in the claims appended hereto. For example, the cross-sectional geometry of the housing of the present muffler may be round, triangular, rectangular, or other multi-sided geometry. Further, the entrance and exit ports may include stub pipes which project from their respective end of the housing as depicted in FIGS. 1–7 or as depicted in FIG. 8, the entrance and exit ports may be provided with tubular adaptors which terminate substantially flush with the outer rims of a port and project inwardly of the housing to be received in the registered ports in the baffle and project beyond the baffle by a short, e.g., about one inch for example, beyond the baffle into the interior of the housing.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed:

1. A muffler for an internal combustion engine having an exhaust, comprising a hollow housing having top, bottom and opposite side walls and first and second opposite ends, and a transverse centerplane, a central post of substantially round transverse cross-section disposed within said housing at a location substantially equidistant between said opposite side walls and substantially equidistant said first and second opposite ends of said housing, a first elongated tubular member mounted within said housing adjacent said central post and on that side of said post facing said first end of said housing, said tubular member being bent along its length and with the inside of said bend facing the outer circumference of said central post, a second elongated tubular member mounted within said housing adjacent said central post and on that side of said post facing said second end of said housing, said tubular member being bent along its length and with the inside of said bend facing the outer circumference of said central post, first and second end plates sealingly closing respective ones of said first and second opposite ends of said housing fluid tight, at least one port defined in one of said first and second end plates for establishing fluid flow communication between the interior of said housing and an ambient conduit leading from the exhaust of the engine and at least one port defined in one of said first and second end plates for establishing fluid flow communication between the interior of said housing and the ambient environment.

2. The muffler of claim 1 and further including first and second baffles disposed in spaced apart, substantially parallel, relationship to respective ones of said first and second end plates, each of said baffles including an outer perimeter which is coincident with the inner cross-sectional geometry of said housing whereby each of said baffles is force-fitted within said housing to define a chamber within said housing between each baffle and its respective end plate, said chamber being essentially closed against the inflow of substantial moisture into said chamber.

3. The muffler of claim 2 wherein each of said baffles includes a port which is in register with a respective one of said at least one port defined in a respective one of said end plates, and including a tubular member inserted through said registered ports to further define a fluid flow passageway between the interior of said housing and the exterior of said housing.

4. The muffler of claim 3 wherein each of said tubular members projects outwardly of said housing beyond its associated end plate and projects inwardly into the interior of said housing beyond its associated baffle.

5. The muffler of claim 3 wherein each of said tubular members includes an outward end which terminates substantially flush with the port defined in its associated end plate.

6. The muffler of claim 1 wherein each of said first and second elongated tubular members includes a first and second end and said first end thereof defines a wedge-shaped opening with a first one of said side walls and said second end defines a wedge-shaped opening with a second one of said side walls, each of said wedge-shaped openings opening toward the transverse centerplane of said housing, said openings providing for the flow of exhaust gases and associated noises into each elongated tubular member.

7. The muffler of claim 6 wherein each of said first and second ends of each of said elongated tubular members includes a circumferential rim and only a limited portion of said rim of each of said first and second ends of each of said first and second elongated tubular members physically engages a respective side wall and including means anchoring said limited portion to a respective side wall.

8. The muffler of claim 1 wherein each of said elongated tubular members includes a longitudinal centerline and is bent substantially centrally of the length thereof at an included angle of about 25 degrees relative to the longitudinal centerline of said tube.

9. The muffler of claim 1 wherein each of said bent elongated tubular members partially wraps said central post.

10. The muffler of claim 9 wherein each of said bent elongated tubular members is anchored to said central post.

11. The muffler of claim 1 and further including third and fourth elongated bent tubular members disposed in aligned stacked relationship to said first and second elongated bent tubular members.

12. The muffler of claim 6 wherein said wedge-shaped openings provide for the entry of exhaust gases and associated noises emanating from the engine to enter said tubular members from opposite ends thereof with resulting modulation or cancellation of at least a portion of said associated noises.

13. The muffler of claim 1 and further including more than two ports defined in at least one end plate of said housing and including means for sealingly closing at least one of said ports.

14. The muffler of claim 1 and further including at least three ports defined in each of said first and second end plates of said housing.

15. The muffler of claim 14 wherein each of said ports is provided with a tubular member having a first end which terminates substantially flush with its respective end plate.

16. A method for modulation of the exhaust gases and noises associated therewith emanating from the exhaust system of an internal combustion engine comprising the steps of connecting a muffler in fluid flow relationship to the exhaust system of the engine whereby gases and associated noises emanating from the engine are directed into and through said muffler, within said muffler, subjecting said exhaust gases and associated noises to flow impediments which present only smooth direction-altering surfaces substantially free of abrupt structural changes of flow direction changes to said exhaust gases moving through the muffler, there being not more than three material flow impediments internally of said muffler and further including the step of directing a portion of said exhaust gases into the opposite ends of at least one elongated bent tube whereby noises associated with said gases are modulated or cancelled.

17. A muffler in accordance with claim 1 and including at least one plug suitable for use in closing at least one port in one end plate of said muffler, said muffler and said at least one plug being packaged as a unit.

* * * * *